US007160076B2

(12) United States Patent
Curl et al.

(10) Patent No.: US 7,160,076 B2
(45) Date of Patent: Jan. 9, 2007

(54) WORK MACHINE WITH BOOM STOP

(75) Inventors: William H. Curl, Bismarck, ND (US); Daniel J. Krieger, Bismarck, ND (US); Robert J. Celley, Bismarck, ND (US)

(73) Assignee: Clark Equipment Company, Woodcliff Lake, NJ (US)

( * ) Notice: Subject to any disclaimer, the term of this patent is extended or adjusted under 35 U.S.C. 154(b) by 0 days.

(21) Appl. No.: 10/944,231

(22) Filed: Sep. 17, 2004

(65) Prior Publication Data

US 2006/0062662 A1 Mar. 23, 2006

(51) Int. Cl.
*E02F 3/00* (2006.01)

(52) U.S. Cl. ..... 414/680; 172/481

(58) Field of Classification Search ..... 414/680, 414/694; 172/466, 481

See application file for complete search history.

(56) References Cited

U.S. PATENT DOCUMENTS

| | | | | |
|---|---|---|---|---|
| 3,223,251 | A | 12/1965 | Rothe et al. | |
| 3,272,558 | A | 9/1966 | Rathman et al. | 298/22 |
| 3,805,463 | A | 4/1974 | Lang et al. | |
| 3,918,601 | A | 11/1975 | Zimmerman | 214/776 |
| 4,033,469 | A | 7/1977 | Frank et al. | |
| 4,039,093 | A | 8/1977 | Schmitz, Jr. et al. | 214/130 R |
| 4,141,257 | A * | 2/1979 | Hammond et al. | 74/529 |
| 4,189,278 | A | 2/1980 | Dewey | 414/713 |
| 4,218,094 | A | 8/1980 | Leaver | |
| 4,275,984 | A | 6/1981 | Lenertz | 414/686 |
| 4,305,619 | A | 12/1981 | Sas | 298/17 B |
| 4,347,031 | A | 8/1982 | Friesen et al. | 414/686 |
| 4,522,554 | A | 6/1985 | Williams et al. | |
| 5,009,566 | A | 4/1991 | Asche | 414/722 |
| 5,531,561 | A * | 7/1996 | Rae et al. | 414/686 |
| 6,149,374 | A | 11/2000 | Dershem et al. | 414/685 |
| 6,729,830 | B1 * | 5/2004 | Wagner et al. | 414/686 |

OTHER PUBLICATIONS

International Search Report.
Written Opinion.

* cited by examiner

*Primary Examiner*—Donald Underwood
(74) *Attorney, Agent, or Firm*—Westman, Champlin & Kelly, P.A.

(57) ABSTRACT

A work machine has a lift arm assembly pivotably coupled to a frame assembly at a forward frame pivot. The lift arm assembly includes a pair of spaced-apart lift arms and an extensible lift cylinder. The lift cylinder is pivotably coupled to the lift arms at a lift cylinder connection pivot. The lift cylinder is pivotably coupled to the frame assembly such that extension of the lift cylinder moves the lift arms with respect to the frame assembly about the frame pivot. A boom stop is pivotably coupled to the lift cylinder connection pivot. The boom stop is movable from an inoperable position with a remote end adjacent the lift arms to an operable position wherein the boom stop engages the frame assembly and prevents lowering movement of the lift arms with respect to the frame assembly. The lift arm assembly also can include a latch assembly coupled to one of the lift arms for holding the boom stop in the inoperable position.

16 Claims, 6 Drawing Sheets

72
74
57B
57A
90
64
28
56B
66
84
56A
86
80
58
88
80A
52B
54
54
55A
52A
55
60
40
50

WORK MACHINE WITH BOOM STOP

BACKGROUND OF THE INVENTION

The present invention relates to a self-propelled vehicle having a front lift arm assembly. More particularly, the present invention relates to a work machine with a lift arm assembly having a boom stop thereon.

A wheeled work machine includes a frame attached to an operator compartment such as a cab. A cargo support is attached to the frame behind the cab. A lift arm assembly is attached to the frame generally in front of the cab and centered on a longitudinal center line of the work machine. The lift arm assembly is movable with respect to the frame and can be attached to one or more work tools such as a bucket. The wheeled work machine is suited for use as a utility vehicle for various tasks.

Many loaders include boom stops to render a raised lift arm assembly inoperable. One example of a boom stop is disclosed in U.S. Pat. No. 5,009,566. The lift arm includes a hydraulic cylinder having a cylinder body attached to the frame of the skid steer loader and an extensible rod attached to the lift arm assembly. When the rod is fully extended from the cylinder body, the boom stop is positioned between the cylinder body and the lift arm assembly, thus preventing the rod from retracting into the cylinder body.

SUMMARY OF THE INVENTION

The present invention is directed to a self-propelled, wheeled work machine having a lift arm assembly pivotably coupled to a front of a frame assembly at a frame pivot. The lift arm assembly includes a pair of spaced-apart lift arms and an extensible lift cylinder. The lift arms are relatively close together so the lift arm assembly is positioned in center portions of the frame. The lift cylinder is pivotably coupled to the lift arms at a lift cylinder connection pivot, and is pivotably coupled to the frame assembly such that extension of the lift cylinder moves the lift arms with respect to the frame assembly about the frame pivot.

A boom stop is pivotably coupled to the lift cylinder connection pivot. The boom stop is movable from an inoperable position adjacent to and retained with the lift arms, to an operable position wherein an end of the boom stop engages the frame assembly and prevents lowering the lift arms with respect to the frame assembly. The boom stop is releasably held with a latch coupled to one of the lift arms. The latch includes a bracket on the boom stop having a retractable pin resiliently urged into an engaged position. In the engaged position, the pin engages a bracket on the one lift arm to hold the boom stop in the inoperable position.

DETAILED DESCRIPTION OF THE PREFERRED EMBODIMENTS

Figure 1:
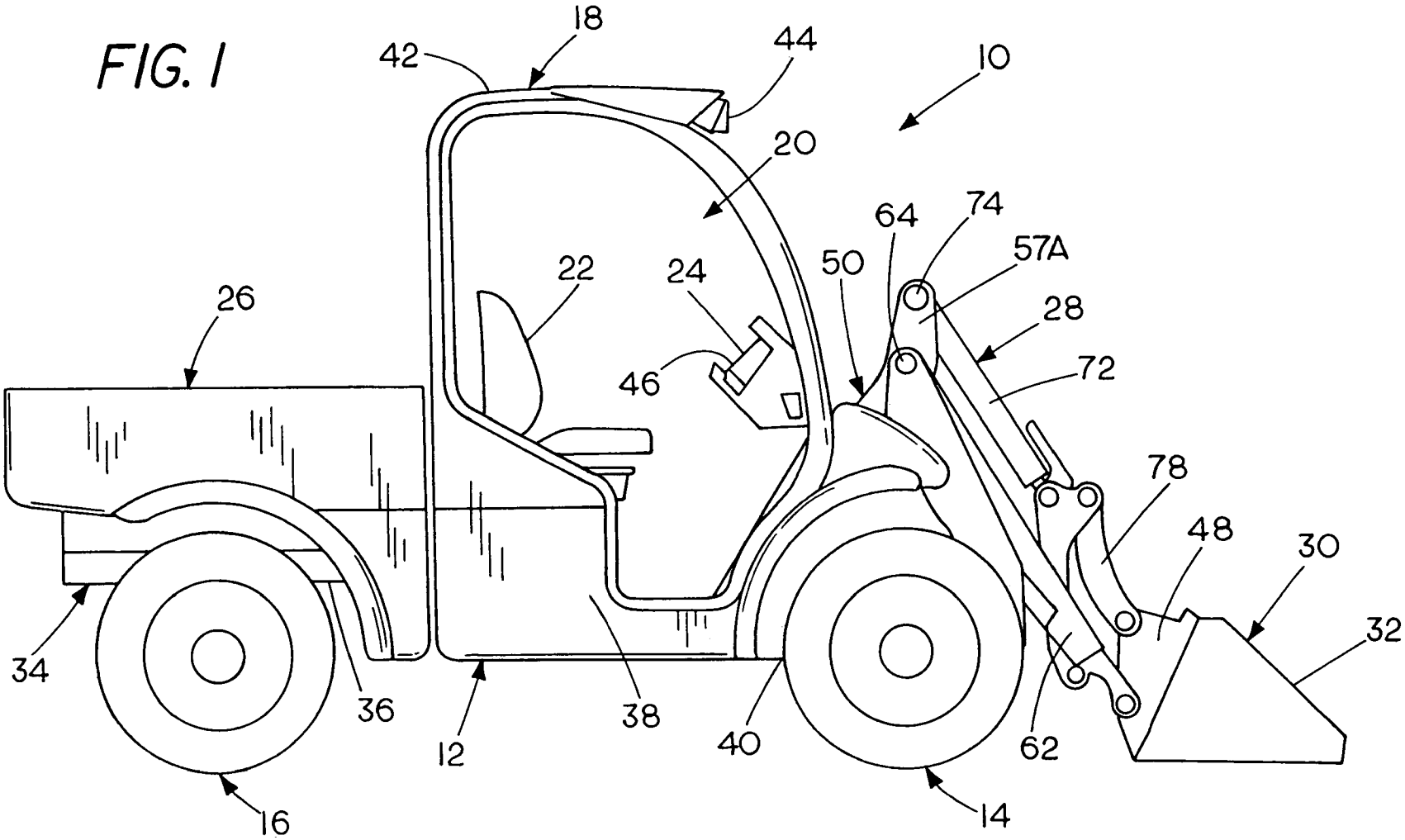
FIG. 1 is a side elevation view of a work machine constructed in accordance with the present invention.

FIG. 1 is side elevation view of an exemplary work machine 10. The work machine 10 includes a frame 12 supported with front and rear wheel assemblies 14, 16 respectively. The frame 12 is attached to a cab 18 that defines an operator compartment 20 having an operator platform, and a seat 22, and operator controls 24. The work machine also includes an engine, not shown, typically disposed between the seat 22 and the rear wheel assembly 16 and attached to the frame 12. The frame 12 also is connected to a cargo support 26, which is disposed behind the seat 22 in the example. A lift arm assembly 28 is positioned in front of the seat 22 and attached to the front portion of frame 12. The lift arm assembly 28 is adapted to receive a removable tool 30, such as a bucket 32 shown in FIG. 1.

In a typical example, the frame 12 is a rigid frame assembly that provides generally no frame articulation between the front and rear wheel assemblies 14, 16. The frame 12 is illustrated as including longitudinal members 34 extending from the front wheel assembly 14 toward the rear wheel assembly 16. The frame includes a cargo support portion 36, a middle portion 38, and a lift arm support portion 40. The lift arm support portion 40 is particularly strengthened to resist bending or twisting from loads carried with lift arm assembly 28. The middle portion 38 is adapted to provide a stable mount for the cab 18 and can be suited to accommodate a transverse mounted engine.

The engine can power either or both of the wheel assemblies 14, 16 to move the work machine 10. The engine is connected to one or both of the wheel assemblies 14, 16, with mechanical drives, hydraulic motors or other suitable devices for power transmission. In the illustrated embodiment, hydraulic drive motors are used to drive the wheels. The wheel assemblies 14, 16 can include suspension systems coupled to the frame 12. A steering linkage can be coupled to the front wheels, rear wheels, or both. In the illustrated embodiment, the wheels are steered using hydraulic cylinders. Controls 24 for the operation of the work machine 10 are mounted in the operator compartment 20.

The cab 18 defines the operator compartment 20. The cab 18 in the example includes a canopy 42 and lights 44. A windshield, windows and doors can also be provided, if desired. The operator compartment 20 includes an instrument cluster and dash 46 generally disposed in front of the seat 22, and includes gauges, controls and the like useful for comfort of the operator and operation of the work machine 10. The seat 22 can include one or more bucket seats or a common bench seat for two or more riders.

More detailed descriptions of a work machine, such as the exemplary work machine 10, are found in U.S. Patent Application Publication No. 2003073400; and also in U.S. Pat. No. 6,729,830, which are both incorporated by reference into this disclosure.

FIG. 1 also shows the lift arm assembly 28 connected to the lift arm support portion 40 of the frame 12. The remote end of the lift arm 28 can be connected to an interface 48 that provides attachments to various tools 30. Such tools 30 can include buckets, grapples, brooms, augers or other tools. The lift arm assembly 28 is coupled to the frame 12 in such a manner that it can be moved with respect to the frame 12.

Movement of the lift arm assembly 28 is effected through the use of hydraulic actuators that receive power from the engine.

Figure 2:
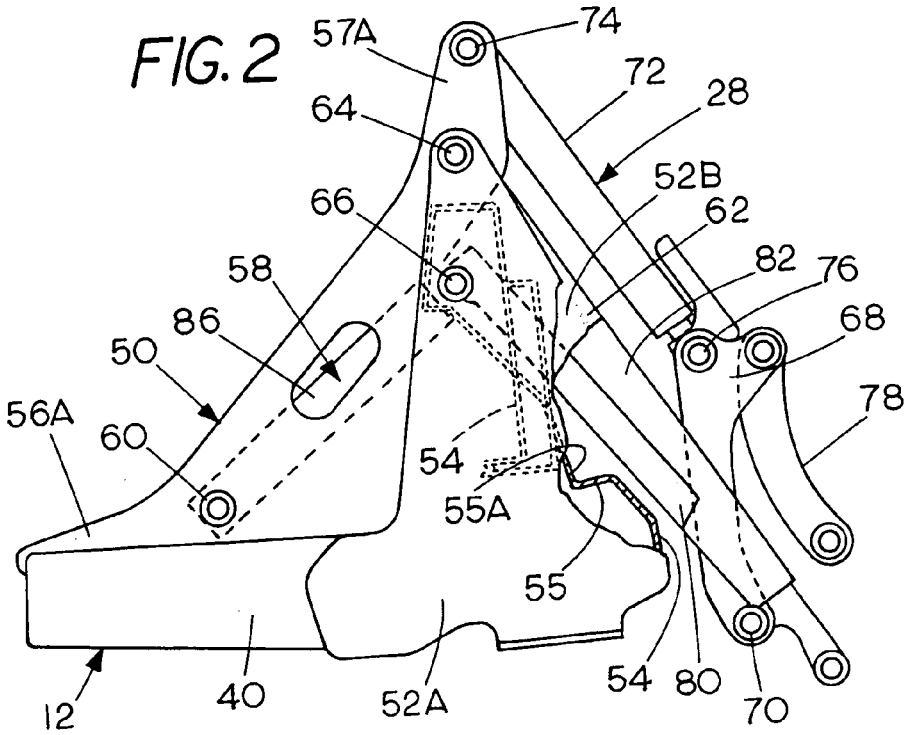
FIG. 2 is a fragmentary side elevation view of a portion of a work machine frame with a lift arm assembly in a lowered position with respect to the frame.

FIG. 2 is a more detailed view of the lift arm assembly 28 as coupled to the frame 12. The lift arm assembly 28 is coupled to a mast assembly 50 that is included in the lift arm support portion 40 of the frame 12. The mast assembly 50 includes a pair of opposing side mast plates 52A and 52B (shown in the elevation view of FIGS. 3, 4 and 7). A cross member 54 is attached to and extends between the side mast plates 52A and 52B, and a pair of spaced brace plates 56A and 56B (FIG. 7) that are positioned to the inside of the side mast plates 52A and 52B. The brace plates 56A and 56B are suitably braced to support a tilt cylinder 72 at upper end portions 57A and 57B of the brace plates 56A and 56B.

The lift arm assembly 28 is pivotably movable with respect to the mast assembly 50. The lift arm assembly 28 includes a lift cylinder indicated generally at 58 positioned between the brace plates 56A and 56B, with the cylinder base supported at a pivot 60. Lift arms 62, which are joined together with cross members, are pivoted between the mast plates 52A and 52B. The lift arms 62 are also pivotably coupled to the rod end of lift cylinder 58 at a connection 66. The remote or outer ends of the lift arms 62 have a tilt link 68 connected thereto at pivot 70. Tilt cylinder 72 is coupled to upper ends 57A and 57B of the spaced brace plates 56A and 56B at tilt cylinder pivot 74, the rod end of tilt cylinder 72 is connected to the tilt link 68 at tilt cylinder connection pivot 76. The tilt link 68 is pivotably coupled to a connector link 78.

The connector link 78 and the remote ends of the lift arms are adapted to be coupled to a tool. In one example as described above, the lift arms 62 and links 78 are coupled to an attachment plate 48 that can be used to support one of several tools. Other examples include the lift arms and links being connected to quick exchange brackets or the lift arms and links may be connected directly to the tool with pin connections.

In the example shown, the lift cylinder 58 and tilt cylinder 72 are hydraulic cylinders and each includes a body or cylinder portion and an extensible rod. The lift cylinder body portion 86 is shown in FIG. 2 coupled to the mast frame assembly 50 and the extensible rod 84 is coupled to the lift cylinder connection 66. The tilt cylinder body portion is shown in Figures coupled to the mast frame assembly 50 and the extensible rod 84 coupled to the link 68. Other configurations are possible. The cylinders 58 and 72 are actuated with operator controls and are powered by the engine.

Figure 3:
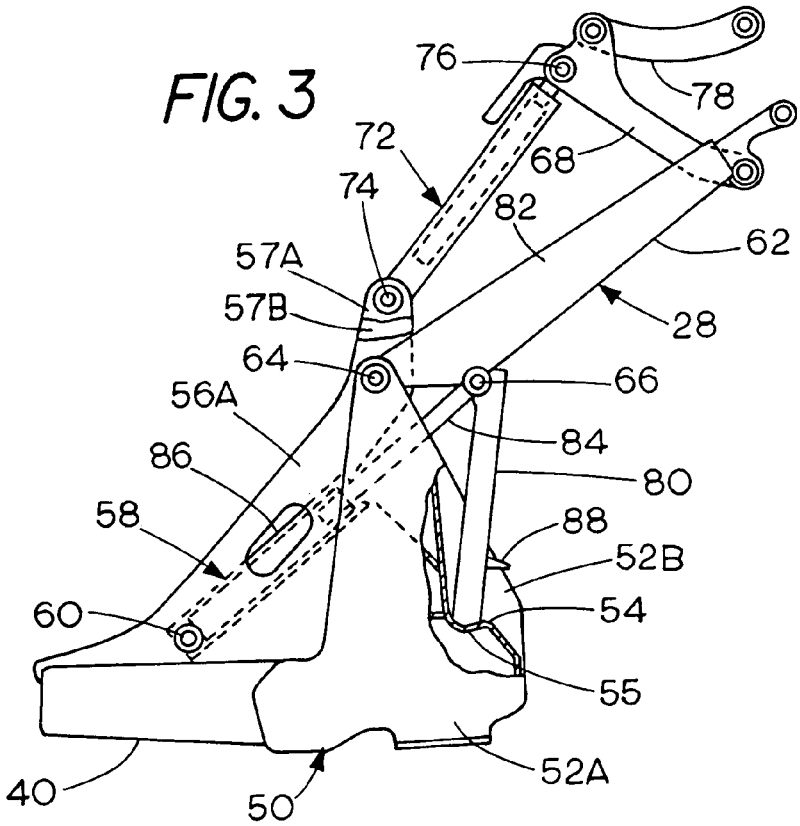
FIG. 3 is a side elevation view of the lift arm assembly in a raised position with respect to the portion of the frame shown in FIG. 2.
Figure 7:
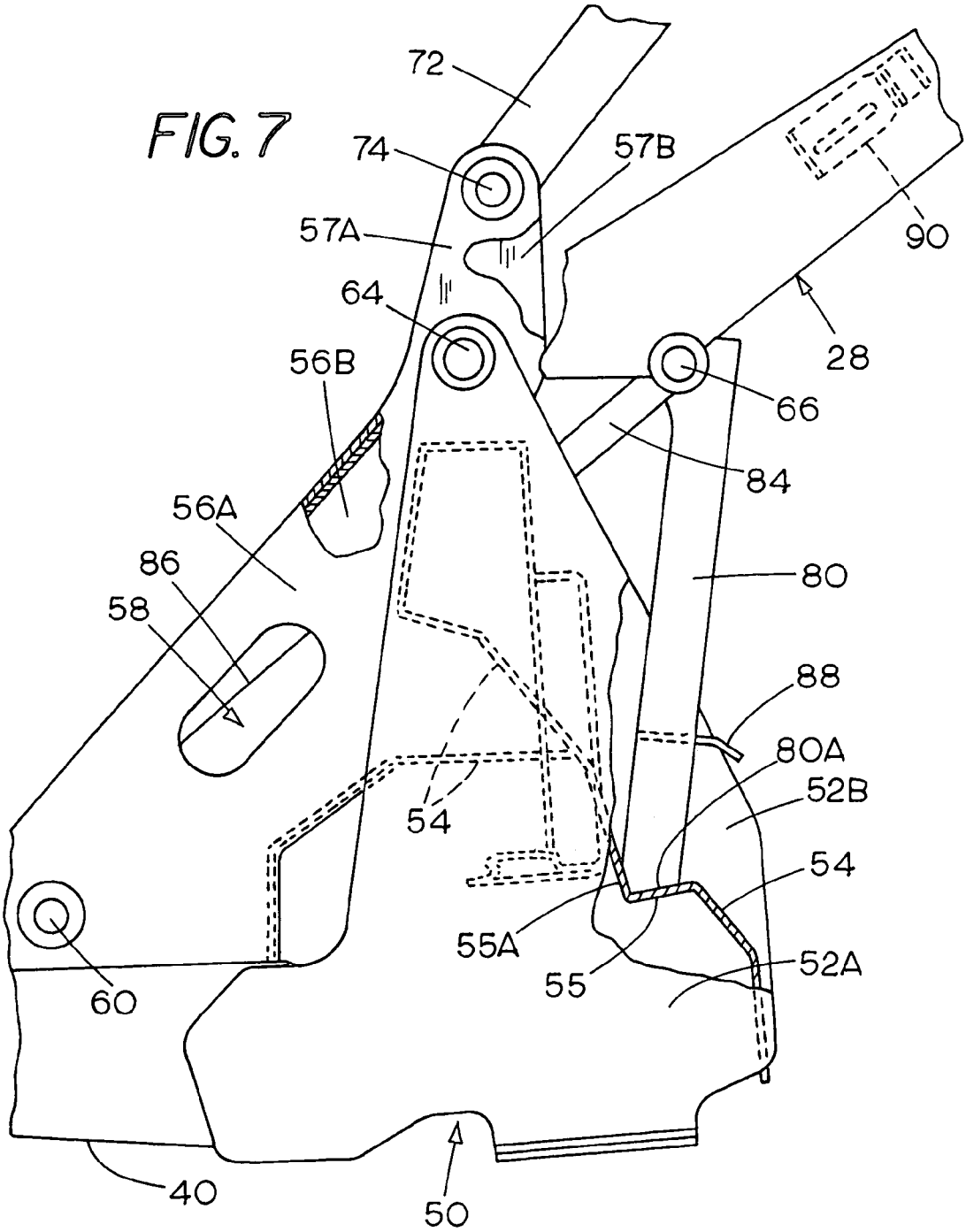
FIG. 7 is an enlarged side view of a portion of the side view of FIG. 3.

FIGS. 2, 3 and 7 also show a lift arm or boom stop 80 having one end pivotably coupled to the rod end pivot 66 of 58. A latch assembly 82 retains the outer end of the boom stop 80 relative to one lift arm. The lift arm or boom stop 80 is held by the latch assembly 82 in a first, stored or inoperative position, with the boom stop 80 generally extending along the length of the lift arm assembly 28. The lift arm or boom stop 80 is shown coupled to the latch assembly 82. The boom stop 80 in the first stored position does not interfere with the operation of the lift arm assembly 28 and the tool 30.

FIGS. 3 and 7 show the lift arms 62 (and thus lift arm assembly) in a raised position with respect to the frame assembly 50 lift cylinder. Rod 84 is extended from the body 86 of the lift cylinder 58 to place the lift arms 62 in the raised position. The lift cylinder 58 can be controlled to extend the rod 84 from the body 86 and thus vary the height of the lift arms 62. FIGS. 3 and 7, however, show the lift arms 62 in a generally fully raised position.

The lift arm or boom stop 80 is also shown disposed in a second, or operative, position in FIGS. 3 and 7, positioned to prevent downward movement of the lift arm assembly 28. In the second position, the latch assembly 82 is released and the outer or remote end 80A of the boom stop moves down as the boom stop pivots about the lift cylinder connection pivot 66. The remote end 80A of the boom stop 80 seats against the offset portion 55 of cross member 54 between the side plates 52A and 52B, or other sturdy member or portion of the frame assembly 50. If the lift cylinder 58 is slightly retracted, the boom stop 80 becomes wedged or otherwise secured in the offset portion 55, and this prevents further retraction of the lift cylinder 58 or downward movement of the lift arm assembly until the lift arm assembly is raised.

The boom stop is stopped right on the vehicle frame, so the boom stop has a large area to rest upon, and the boom stop does not extend along the lift cylinder rod. The boom stop is independent from the lift cylinder. The offset portion 55 also tilts upwardly slightly to retain the boom stop 80 positively. The remote end of the boom stop is trimmed at a mating angle.

Extension of the lift cylinder 58 permits manual removal of the remote end of the boom stop 80 from the raised outer edge of the offset frame portion 55. The lift arm assembly is raised sufficiently to provide clearance. The boom stop 80 then can be manually placed in the first stored or inoperative position again and latched in place with latch assembly 82.

Figure 4:
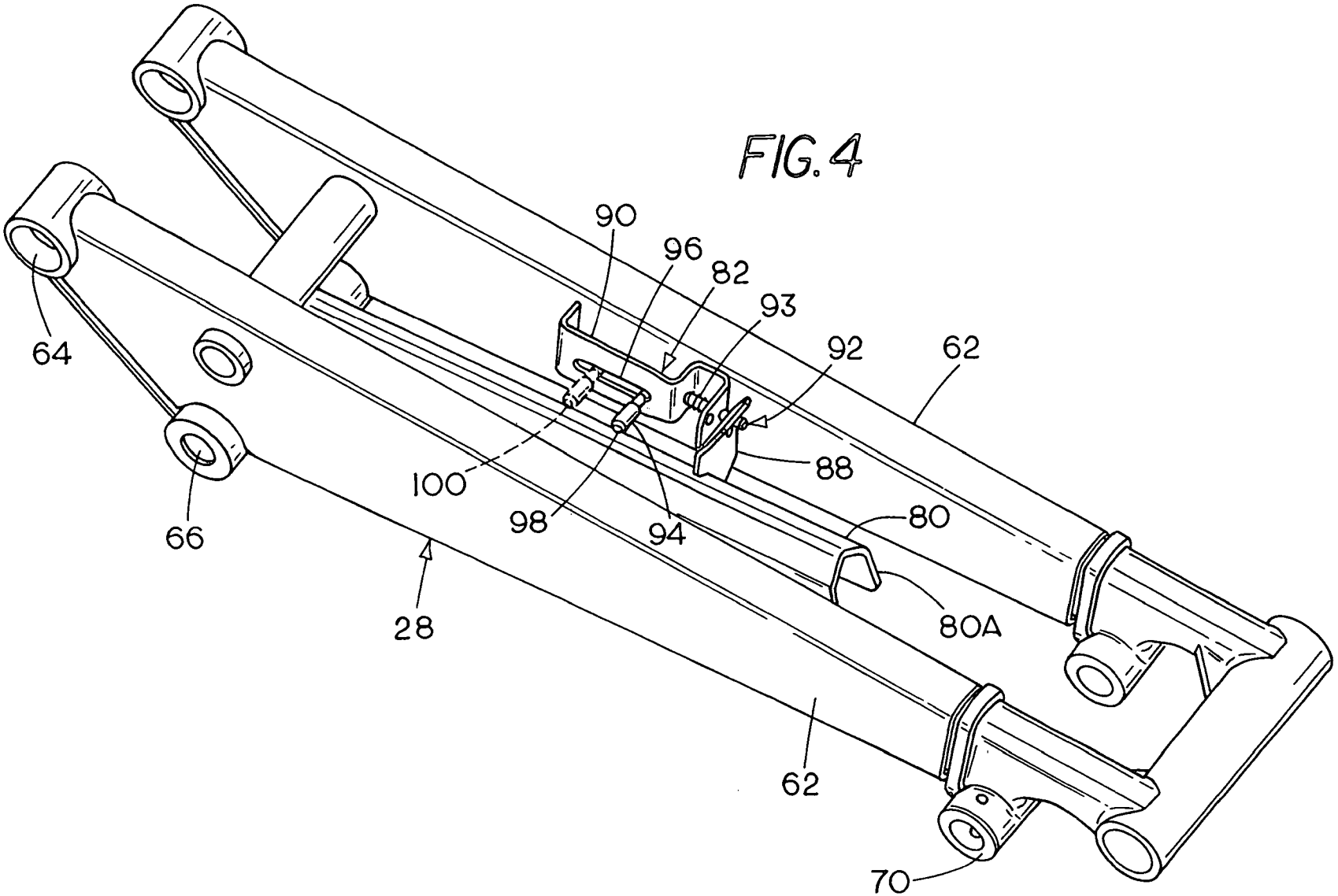
FIG. 4 is a perspective view of a portion of the lift arm assembly shown in FIGS. 2 and 3.
Figure 5:
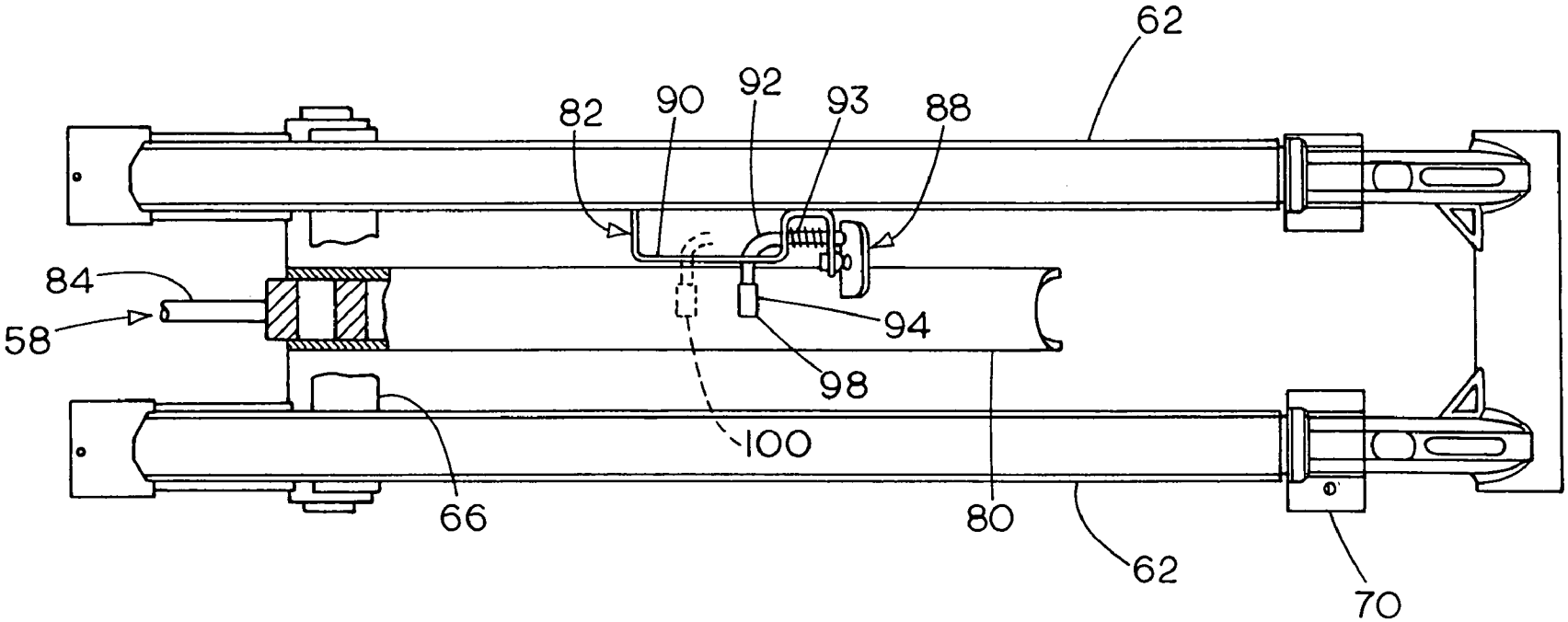
FIG. 5 is a plan view of the lift arm assembly shown in FIG. 4.

FIGS. 4 and 5 show additional views of the pair of lift arms 62, boom stop 80, and latch assembly 82. In the example shown, the boom stop 80 is mounted between the pair of lift arms 62 and is formed out of a U-shaped bar or strut for strength. The boom stop 80 includes a connection plate 88 that is a portion of the latch assembly 82. The latch assembly 82 in the example includes an S-shaped bracket 90 attached to one of the lift arms 62 and containing a spring-loaded pin 92. The spring-loaded pin 92 includes a spring 93, a handle 94 that extends through slot 96 in the S-shaped bracket 90, and a tip or end 95 that projects from an end wall of bracket 90 and will fit into a hole 102 provided in the connection plate 88 to retain the boom stop 80 in the first inoperative or stored position.

Figure 6:
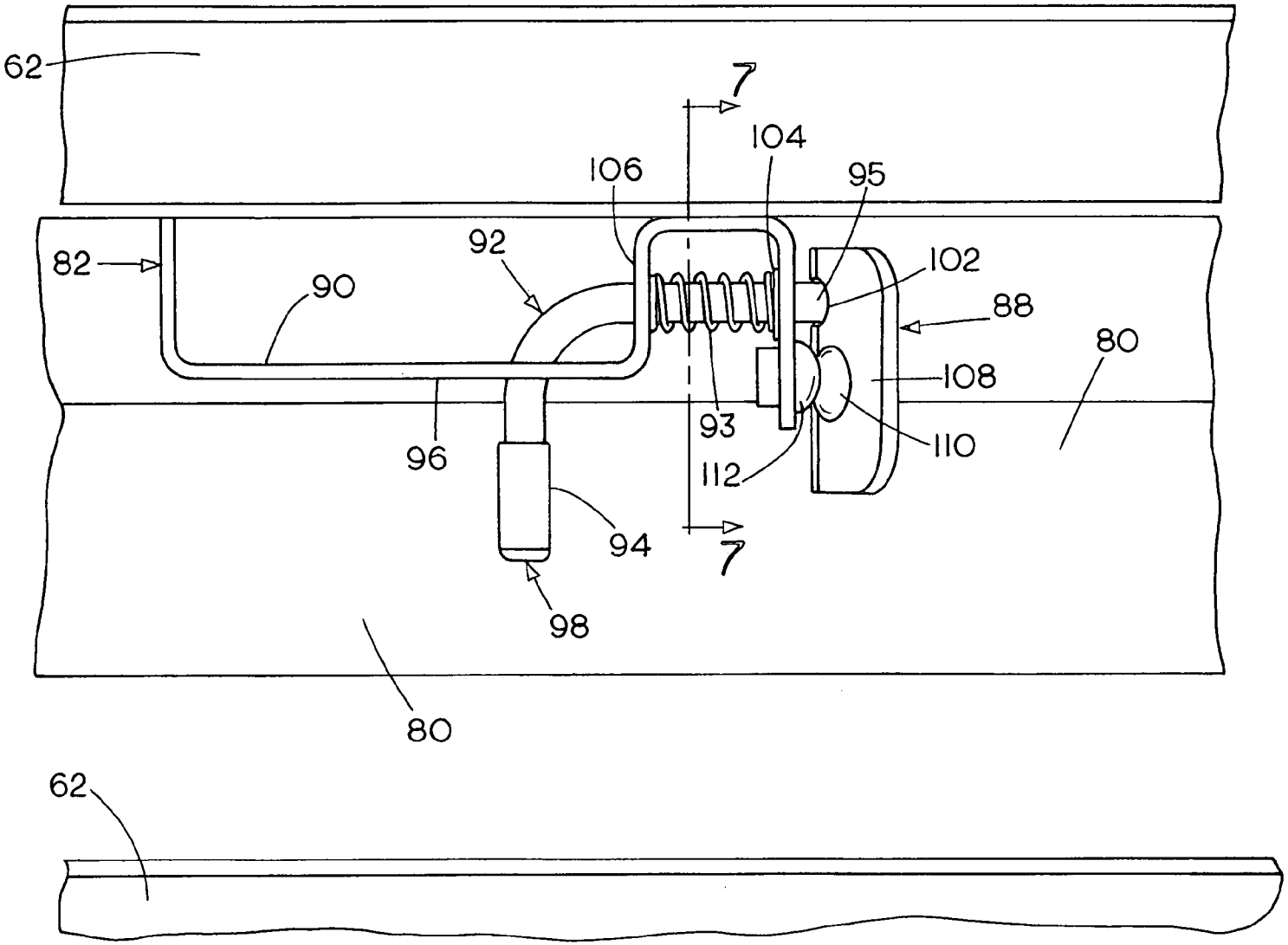
FIG. 6 is a plan view of a portion of the lift arm assembly shown in FIG. 5.

The pin 92 is resiliently urged to an engaged position 98, and is movable from the engaged position 98 of the handle to a disengaged position 100. In the engaged position 98, also shown in FIG. 6, the tip 95 of the pin 92 extends through hole 102 on the connection plate 88. The spring 93 holds the pin 92 in place and secures the boom stop 80 in the first position and along the lift arms 62. The pin 92 also carries a keeper 104 for the spring 93 to retain the spring 93 in position on the pin 92. In one example, the keeper 93 is a snap ring. When the handle 94 is pulled toward the disengaged position 100, the spring 93 is compressed between the keeper 104 and a middle bar 106 of the S-shaped bracket 90. The pin 92 slides out of the hole 102 of the connection plate 88, and the boom stop 80 is decoupled from the bracket 90 of the latch assembly 82.

When the handle 94 is released the spring 93 urges the tip 95 away from the bracket 90 and the latch assembly 82 is ready for coupling to the boom stop 80. The connection plate 88 includes an angled lip portion 108 that guides the tip 95 of the pin 92 back into the hole 102 as the boom stop 80 is moved into the first position. The tip 95 slides along the lip 108 and then extends through the hole 102 to lock the boom stop 80 into the first position. The connection plate 88 in the example also includes a resilient bumper 110 that mates with a resilient button 112 attached to the bracket 90. The resilient material for the bumper 110 and button 112, such as rubber or another elastomeric material serves to prevent the boom stop 80 from rattling during operation of the machine 10. In another example, the connection plate 88 can be attached to one of the lift arms and the bracket 90 and spring would be attached to the boom stop.

The boom stop latch assembly 82 can be released to drop the remote end down and the boom stop will pivot as the lift arm assembly is raised. The remote end of the boom stop 80 will slide along the raised front edge of offset portion 55 until the edge of the tapered end 80A of the boom stop 80 is over the front edge of the offset section 55. The remote end then swings to the position of FIGS. 3 and 7 under gravity against a vertical frame section 55A as the lift arms are raised. When the lift arms are lowered, the cooperating tapered end 80A will seat securely on the tilted upper surface of offset frame portion 55. The boom stop cannot be manually moved back to its stored or inoperative position until the lift arms are raised again sufficiently to provide clearance for pivoting the boom stop upwardly.

Although the present invention has now been described with reference to preferred embodiments, workers skilled in the art will recognize that changes may be made in form and detail without departing from the spirit and scope of the invention.

What is claimed is:

1. A work machine, comprising:

a lift arm assembly pivotably coupled to a frame assembly at a frame pivot;

the lift arm assembly including a pair of spaced-apart lift arms and an extensible lift cylinder, wherein the lift cylinder is pivotably coupled to the lift arms at a lift cylinder connection pivot and the lift cylinder is pivotably coupled to the frame assembly such that extension of the lift cylinder moves the lift arms with respect to the frame assembly about the frame pivot; and a boom stop pivotably coupled to the lift cylinder connection pivot and movable from an inoperable position adjacent the lift arms to an operable position wherein an outer end of the boom stop engages the frame after the lift arms are raised with respect to the frame assembly.

2. The work machine of claim 1, wherein the lift arms are pivotably coupled to the frame assembly between a pair of spaced-apart side plates having a frame cross member between the side plates, and wherein the outer end of the boom stop engages the cross member at a location between the side plates and forwardly of the lift cylinder when moved into the operable position.

3. The work machine of claim 1, wherein the boom stop is movable into the operable position when the lift cylinder is extended a selected amount.

4. The work machine of claim 1, wherein the boom stop in the inoperable position is coupled to one of the lift arms with a releasable latch assembly.

5. The work machine of claim 4, wherein the latch assembly is attached to the one of the lift arms and includes a retractable pin, and the boom stop includes a connection plate that is engaged by the retractable pin to couple the boom stop to the one of the lift arms.

6. The work machine of claim 5, wherein the latch assembly includes a bracket with a spring containing the pin, and the pin is resiliently urged into an engaged position with the connection plate by the spring.

7. The work machine of claim 6, wherein the pin is retractable into a disengaged position, and wherein the outer end of the boom stop is decoupled from the lift arm when the pin is retracted into the disengaged position.

8. The work machine of claim 4, wherein the latch assembly includes at least one resilient member engaging the connection plate when the boom stop is coupled to one of the lift arms.

9. A wheeled work machine, comprising:

a frame including a cargo support portion, a middle portion, and a lift arm support portion, wherein the middle portion is disposed between the cargo support portion and the lift arm support portion, the lift arm support portion including a frame assembly;

a lift arm assembly pivotably coupled to the frame assembly at a frame pivot;

the lift arm assembly including a pair of spaced-apart lift arms and an extensible lift cylinder, wherein the lift cylinder is pivotably coupled to the lift arms at a lift cylinder connection pivot and the lift cylinder is pivotably coupled to the frame assembly such that extension of the lift cylinder moves the lift arms with respect to the frame assembly about the frame pivot to raise outer ends of the lift arms;

a boom stop having a first end pivotably coupled to the lift arms at the lift cylinder connection pivot, and the boom stop being movable about the lift cylinder connection pivot from an inoperable position with a second end of the boom stop adjacent and extending toward the outer ends of the lift arms and to an operable position after the outer ends of the lift arms have been moved to a raised position, wherein the second end of the boom stop can drop downwardly to engage the frame assembly and stop downward movement of the lift arms from the lift arms raised position with respect to the frame assembly; and a latch assembly coupled between one of the lift arms and the boom stop to hold the boom stop in its inoperable position to move with the lift arms, and the latch assembly being releasable to permit the outer end of the boom stop to drop downwardly.

10. The wheeled work machine of claim 9, wherein the latch assembly includes a bracket having a retractable pin resiliently urged into an engaged position, wherein the pin in the engaged position couples the boom stop to the one of the lift arms when the boom stop is in the inoperable position.

11. The wheeled work machine of claim 9, wherein the middle portion of the frame is adapted to attach to a cab defining an operator compartment, and the cargo support portion is adapted to attach to a cargo support.

12. The wheeled work machine of claim 11, wherein the cab is disposed between the cargo support and the lift arm, and the lift cylinder moves the lift arms with respect to the frame assembly about the frame pivot away from the cargo support and the cab.

13. A lift arm assembly for a wheeled work machine having a frame wherein the lift arm assembly has a base end and an outer end, and the outer end being movable with respect to the frame, the frame having a forward cross member, the lift arm assembly, comprising:

an extensible lift cylinder coupled to the lift arm assembly at a lift cylinder connection pivot;

a lift arm stop having one end pivotally coupled to the lift arm assembly at a location adjacent the base end of the lift arm assembly, the lift arm stop pivotally movable to a stored position with a remote end extending toward and terminating short of the outer end of the lift arm assembly and positioned adjacent to the lift arm assembly, and a released position wherein the remote end of the lift arm stop pivots downwardly as the outer end of the lift arm assembly is raised, and the length and the pivotal coupling location of the lift arm stop being selected such that when the outer end of lift arm assembly is raised a predetermined amount the remote end of the lift arm stop is adapted to overlie an upper surface of a forward cross member of a frame supporting the lift arm assembly to prevent the lift arm assembly from lowering; and cooperative latch elements on the lift arm stop and the lift arm assembly to releasably hold the lift arm stop in its stored position.

14. The lift arm assembly of claim 13 wherein the cooperative latch elements comprise a latch bracket coupled to the lift arm assembly and a connection plate on the lift arm stop, the latch bracket carrying a retractable pin and a spring, wherein the spring resiliently urges the retractable pin into an engaged position, and wherein the pin in the engaged position mates with the connection plate on the lift arm stop and couples the lift arm stop to the lift arm assembly when the lift arm stop is in the stored position.

15. The lift arm assembly of claim 14, wherein the latch bracket includes at least one resilient button that engages the connection plate when the lift arm stop is coupled to the lift arm assembly.

16. The lift arm assembly of claim 13 wherein the lift arm stop is pivotally coupled to the lift arm assembly at the lift cylinder pivot connection.

* * * * *